United States Patent [19]

Sekiguchi

[11] 3,940,598

[45] Feb. 24, 1976

[54] METHOD AND APPARATUS FOR CONTROLLING ROLL GAPS OF COLD ROLLING MILLS

[75] Inventor: Kunio Sekiguchi, Kawagoe, Japan

[73] Assignee: Tokyo Shibaura Denki Kabushiki Kaisha, Japan

[22] Filed: Sept. 25, 1974

[21] Appl. No.: 509,227

[30] Foreign Application Priority Data

Sept. 28, 1973 Japan ..... 48-109110

[52] U.S. Cl. ..... 235/151.1; 72/7; 444/1

[51] Int. Cl.[2] ..... B21B 37/00

[58] Field of Search ..... 235/151.1

[56] References Cited

UNITED STATES PATENTS

| | | | |
|---|---|---|---|
| 3,787,667 | 1/1974 | King et al. | 235/151.1 |
| 3,820,711 | 6/1974 | Economopoulos et al. | 235/151.1 |

*Primary Examiner*—Eugene G. Botz

*Attorney, Agent, or Firm*—Stevens, Davis, Miller & Mosher

[57] ABSTRACT

In a method of controlling the roll gap of a cold rolling mill of the class wherein the rolling load is first estimated and then the roll gap is calculated, the deformation resistance of the material being rolled is determined in accordance with a constant determined by the reduction, the strain rate, and the temperature and quality of the strip being rolled; the exit strip temperature is determined by taking into consideration the reduction and the characteristics of the rolling mill; the mean deformation resistance of the strip is determined from the deformation resistance and the exit strip temperature; the rolling pressure is calculated in accordance with the equation as hereinbelow defined for determining the rolling pressure by using the mean deformation resistance; and then the roll gap is determined and controlled in accordance with the equation of a gauge meter as hereinbelow defined.

10 Claims, 6 Drawing Figures

METHOD AND APPARATUS FOR CONTROLLING ROLL GAPS OF COLD ROLLING MILLS

BACKGROUND OF THE INVENTION

This invention relates to a method and apparatus for controlling the roll gap of a cold rolling mill designed to roll steel sheets or sheets of nonferrous metals, such as aluminum, to obtain products having definite thickness.

In order to set the roll gap of a rolling mill to a desired value, it is necessary to measure or estimate the rolling pressure. Generally, however, the rolling pressure is not distributed uniformly along the contact arc between the working rolls of the mill and the strip being rolled due to variations in the coefficient of friction between the working rolls and the strip and variations in the deformation resistance of the strip. Accordingly, it is necessary to precisely calculate the distribution of the rolling pressure in order to correctly determine the rolling pressure. The use of such calculation as a model for controlling a cold mill with an electronic computer complicates the calculation and hence is not practical. Accordingly, it has been the general practice to predetermine the rolling pressure by using the following equation 1 which is usually used to obtain the rolling pressure of a cold mill in which the coefficient of friction and the deformation resistance are expressed as mean definite values.

$$p = Z \cdot Km \sqrt{R' \cdot \Delta h} \cdot Qp \qquad 1$$

where $p$ : the rolling load per unit width in kg/mm, $Z$ : the compensation coefficient for tension, $KM$ : the mean deformation resistance in kg/mm$^2$, $R'$ : the roll radius in mm after the roll has been slightly flattened by contact with the material being rolled, $\Delta h$ : the amount of reduction mm, and $Qp$ : the function regarding the rolling force.

Although it is necessary to determine the mean deformation resistance $Km$, in the case of cold rolling, the resistance is different at the entrance and the exit sides of the mill due to the hardening of the material caused by rolling. For this reason, it is usual to calculate the mean total reduction $r$ which is used to determine the mean deformation resistance $Km$ from the overall reduction rate of the material at the entrance and exit sides on the assumption that the deformation resistance of the material is a function of the total reduction (the reduction at an instant after the strain becomes zero). The values of $Km$ and $\bar{r}$ at this time are expressed by the following equations 2 and 3.

$$Km = 1.15\, Kf(\bar{r}) \qquad 2$$

$$\bar{r} = \beta_1 \bar{r}_E + (1 - \beta_1)\bar{r}_x \qquad 3$$

where $Kf$ : the deformation resistance in kg/mm$^2$, $\bar{r}$ : the mean total reduction, $\bar{r}_E$ : the total reduction of the strip on the entrance side, $\bar{r}_x$ : the total reduction of the strip on the exit side, $\beta_1$ : the distribution coefficient of the reduction (to be described later in detail in connection with the distribution coefficient of temperature)

However, the strain rate of the strip during rolling varies depending upon the rolling conditions. Further, the deformation resistance decreases due to the heat generated by plastic deformation of the material. In modern cold mills operating at high rolling speeds, it is impossible to ignore the effects of the strain rate and the strip temperature upon the deformation resistance of the material.

Accordingly, in order to improve the quality of the product it is important to accurately determine the deformation resistance of the material whereby to more accurately control the setting of the roll gap. To this end, the deformation resistance should be determined as a function of the total reduction, the strain rate and the strip temperature.

When determining the mean deformation resistance on the assumption that the deformation resistance is a function of the total reduction, the strain rate and the strip temperature, how to determine the mean total reduction or the strip temperature presents a problem.

As above described, the coefficient of friction between the rolls of a cold rolling mill and the material and the deformation resistance thereof are unknown factors involved in the mathematical model for setting the roll gap of the mill, so that the accuracy and the complexity of the mathematical model are determined by the manner of handling these two factors.

Although it is possible to determine relatively easily the deformation resistance of the material in a factory or laboratory by using a tension testing machine or the like, the coefficient of friction must be determined by using a commercial rolling mill to which the invention is to be applied and where there is a number of types of the material, such as aluminum, it is not only difficult to determine at high accuracies the coefficient of friction for all types of the material but this also requires much time. For this reason, it is possible to more readily form the model and to simplify the form thereof by determining a correct value of the deformation resistance for each material and to make simpler the form of the model.

Since the recrystallization temperature of aluminum is low, it is not permissible to ignore the effect of lowering the deformation resistance caused by the temperature rise due to rolling. Rolling oil is often used to make flat and smooth the surface of the rolled product so that it is necessary to use oil having a low boiling point and hence it vaporizes at a relatively low temperature. For this reason, when the temperature of the material increases due to the rolling operation there is a danger of a fire hazard. Accordingly, it is necessary to determine the extent of temperature rise of the material caused by rolling for the purpose of reflecting it upon the deformation resistance.

SUMMARY OF THE INVENTION

Accordingly, it is an object of this invention to provide a method of controlling the roll gap of a cold rolling mill wherein the deformation resistance of the material being rolled is determined at a high accuracy for the purpose of setting the initial value of the roll gap at a high accuracy.

Another object of this invention is to provide a novel method of controlling the roll gap of a cold rolling mill wherein the temperature of the strip on the exit side is forecast from the strip temperature on the entrance side and the reduction for correcting the rolling schedule thus limiting the strip temperature on the exit side below a predetermined value.

Still another object of this invention is to provide a novel control apparatus for carrying out the method described above.

A feature of the invention lies in a control in which the mean deformation resistance of a strip being rolled is accurately determined thereby providing a most suitable roll gap in accordance with the difference in the quality of the material and with the variation in the rolling conditions.

According to this invention, these and further objects can be accomplished by providing a method of controlling the roll gap of a cold rolling mill comprising the steps of determining the deformation resistance of the material being rolled in accordance with a constant determined by the reduction, the strain rate, and the temperature and quality of the strip being rolled, determining the temperature of the strip on the exit side of the mill from the entrance strip temperature by taking into consideration the reduction and the characteristics of the rolling mill, determining the mean deformation resistance of the strip from the deformation resistance and the exit temperature, calculating the rolling load in accordance with an equation for determining the rolling pressure by using the mean deformation resistance, then determining the roll gap in accordance with the equation of a gauge meter as hereinbelow defined and controlling the roll gap of the mill in accordance with the roll gap determined as above described.

More particularly, in accordance with this invention, the deformation resistance is determined in accordance with an equation $$K_f = l \cdot (\bar{r} + m)^{n_1} \cdot \epsilon^{n_2} \exp(\alpha/T)$$

where $K_f$ represents the deformation resistance in kg/mm$^2$, $\bar{r}$ the total reduction, $\epsilon$ the strain in sec$^{-1}$, $T$ the strip temperature in °K, $l$ and $m$ constants, $n_1$ an exponent dependent upon the reduction, $n_2$ an exponent dependent upon the strain rate, and $\alpha$ an exponent dependent upon the temperature in °K. Then the temperature $T_{EX}$ in °K of the strip on the exit side of the mill is determined in accordance with the following equation $$T_{EX} = T_{EN} + \frac{1 - \frac{r}{4}}{1 - \frac{r}{2}} \cdot \frac{Km \cdot \ln\left(\frac{1}{1-r}\right)}{\rho S J}$$

where $T_{EN}$ represents the temperature in °K of the strip on the entrance side, .l r the reduction, $\rho$ the density of the material in kg/mm$^3$, $S$ the specific heat of the material in K cal/kg °C, $J$ the work equivalent of heat in kg mm/K cal, and $Km$ the mean deformation resistance in Kg/mm$^2$.

Then the mean deformation resistance is determined in accordance with the following equations $$Km = 1.15..l\,(\bar{r}_m + m)^{n_1} \cdot \epsilon^{n_2} \cdot \exp(\alpha/\overline{Tm})$$

$$\bar{r}m = \beta_1 \bar{r}_{EN} + (1 - \beta_1)\bar{r}_{EX}$$

$$\overline{Tm} = \beta_2 T_{EN} + (1 - \beta_2) T_{EX}$$

where $l$, $m$, $n_1$, $n_2$, $\epsilon$, $\alpha$ and $\beta$, have the same meanings as defined hereinabove, and $\beta_2$ represents the distribution coefficient of temperature and $\overline{Tm}$ represents the mean value of the strip temperature.

Then the value of the mean deformation resistance $Km$ thus determined is substituted in the following equation to determine the rolling load $p$ $$p = Z \cdot KM \sqrt{R' \cdot \Delta h \cdot QP}$$

where $p$ represents the rolling load in Kg/mm per unit width, $Z$ a correction term for tension, R′ the roll radius in mm of the roll after it has been slightly flattened by contact with the material, $\Delta h$ the amount of reduction and $Qp$ the function regarding the rolling force. Finally, the value of $p$ Kg/mm thus determined is substituted in the following equation to determine the roll gap $S_o$.

$$S_o = h - \frac{b \cdot p}{M}$$

where $h$ represents the thickness of the strip on the exit side, $b$ the width of the strip in mm, and $M$ the mill constant in Kg/mm. Stated in another way, the method of controlling the roll gap of this invention comprises the steps of forecasting the temperatures of the strip on the exit sides of respective mill stands in accordance with various parameters including the mill constant, the thickness of the strip, the temperature of the strip, etc., correcting the forecast exit strip temperatures to predetermined permissible values when the forecast exit strip temperatures are different from the predetermined permissible values, determining the deformation resistance in accordance with the reduction, the strain rate, the distribution coefficient of the total reduction, etc. of each mill stand and controlling the extent of screw down of each mill stand in accordance with the mean deformation resistance.

In accordance with another aspect of the invention there is provided apparatus for controlling the roll gap of a cold rolling mill comprising a rolling mill having a pair of rolls for rolling a metal strip and a screw down device for adjusting the gap between the rolls, a driving motor for driving the rolls, a speed control device of the motor, a computer having its output connected to the screw down device and the speed control device, means for measuring the temperature of the strip before it is rolled and for setting the measured temperature in the computer, means for setting constants and functions related to the quality of the strip in the computer, means for setting a predetermined rolling schedule in the computer and means for setting the mill constant in the computer.

According to this invention, the roll gap is set by using readily detectable parameters and equations of simple forms so that it is possible to accurately control the roll gap by means of a simple computer.

DESCRIPTION OF THE PREFERRED EMBODIMENTS

Figure 1:
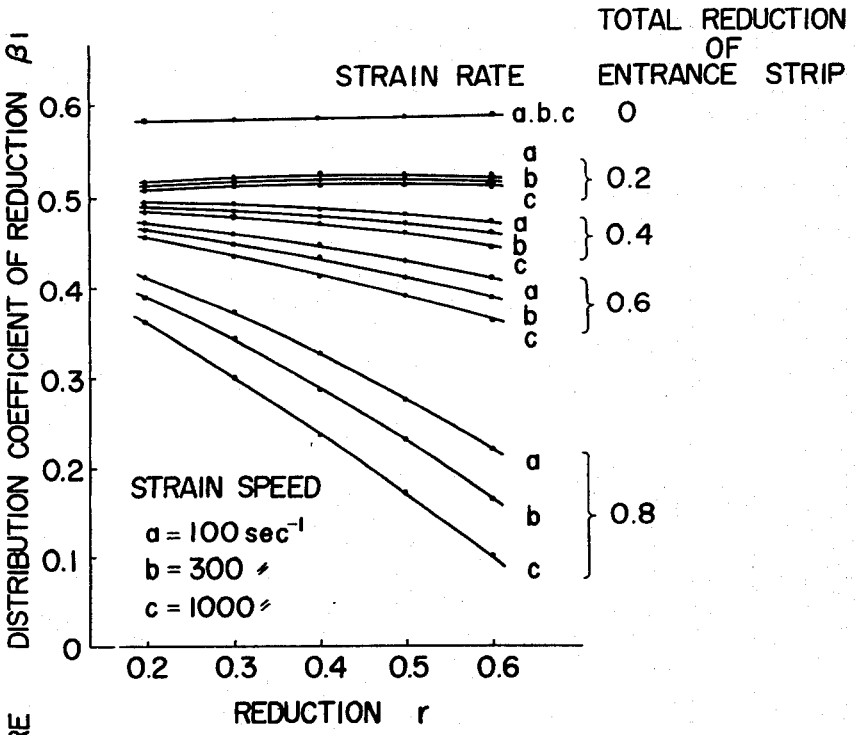
FIG. 1 is a chart illustrating one example of the distribution coefficient of reduction.

Preferred embodiments of the method and apparatus of the invention will now be described in detail.

One example of an equation for calculating the deformation resistance of the material being rolled as a function of the total reduction, the strain rate and the strip temperature as described above is shown by the following equation 4.

$$K_f = l\,(\bar{r} + m)^{n_1} \epsilon^{n_2} \exp(\alpha/T) \qquad 4$$

where $K_f$ : the deformation resistance in Kg/mm$^2$.

$\bar{r}$ : the total reduction,
$\epsilon$ : in the strain rate in sec.$^{-1}$,
$T$ : the strip temperature in °K,
$l$ and $m$ : constants,
$n_1$ : the exponent depending upon the reduction,
$n_2$ : the exponent depending upon the strain rate, and
$\alpha$ : the exponent dependent upon temperature in °K.

In equation 4, constants that are determined by the quality of the material being rolled are $l$, $m$, $n_1$, $n_2$ and $\alpha$ and these variables can be readily determined by using a compression testing machine or a tension testing machine or the like.

Regarding the strip temperature T, in the case of a high speed deformation as in cold rolling, since it is possible to consider that the deformation is performed under an adiabatic state, we may assume that neraly all work, that is energy, is converted into heat and the strip temperature is elevated by this heat. The following equation 5 shows one example of the equation for calculating the heat generated by reduction.

$$T_{EX} = T_{EN} + \frac{1 - \frac{r}{4}}{1 - \frac{r}{2}} \cdot \frac{Km \cdot \ln\left(\frac{1}{1-r}\right)}{\rho S J} \qquad (5)$$

where
$T_{EX}$ : the strip temperature in °K on the exit side
$T_{EN}$ : the strip temperature in °K on the entrance side
$r$ : the reduction
$\rho$ : the density of the material being rolled in Kg/mm$^3$
$S$ : the specific heat of the material in K cal/kg °C
$J$ : the work equivalent of heat in Kg . mm / K cal
$Km$ : the mean deformation resistance in Kg/mm$^2$ While the mean deformation resistance Km is obtained by substituting equations 4 and 5 into equation 6 to be described later we use a mean reduction $\bar{r}m$ and a mean strip temperature $\bar{T}m$ which are calculated from the mean total reduction $\bar{r}_{EN}$ and $\bar{r}_{EX}$ on the entrance side and exit side respectively, and from the strip temperatures $T_{EN}$ and $T_{EX}$ on the entrance side and exit side respectively in accordance with the following equations 7 and 8.

Thus, $$Km = 1.15 l (\bar{r}m + m)^{n_1} \cdot \epsilon^{n_2} \exp(\alpha \bar{T}m) \qquad 6$$
$$\bar{r}m = \beta_1 \bar{r}_{EN} + (1 - \beta_1) \bar{r}_{EX} \qquad 7$$
$$\bar{T}m = \beta_2 T_{EN} + (1 - \beta_2) T_{Ex} \qquad 8$$

where $l$, $m$, $n_1$, $n_2$, $\epsilon$, $\alpha$ and $\beta_1$ have the same meanings as defined above and $\beta_2$ represents the temperature distribution coefficient.

The temperature distribution coefficient $\beta_2$ and the reduction distribution coefficient $\beta_1$ (See equation 3) are obtained as follows. Thus, approximate values of the deformation resistance and the strip temperature at respective points of strip in contact with the rolls are firstly determined, and the mean values $Km$ and $\bar{T}m$ of the deformation resistance and the strip temperature are calculated. Then, $\beta_1$ and $\beta_2$ are determined by substituting the mean values $Km$ and $\bar{r}m$ in equations 7 and 8.

One example of the values of the distribution coefficient of reduction $\beta_1$ is shown in FIG. 1. These values were obtained for JIS 5052 aluminum alloy. The curves shown in FIG. 1 clearly show that the value of $\beta_1$ varies greatly depending upon the rolling conditions. Accordingly, $\beta_1$ can be expressed as follows as a function of the rolling conditions.

$$\beta_1 = f_1 (\bar{r}_{EN} \cdot r \cdot \epsilon) \qquad 9$$

Figure 2:
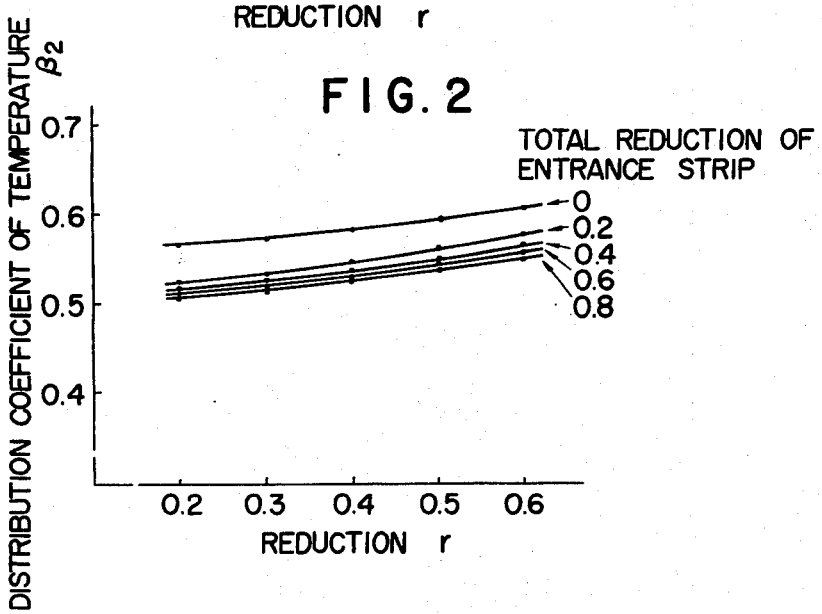
FIG. 2 is a chart illustrating one example of the distribution coefficient of temperature.

FIG. 2 shows the relationship between the reduction $r$ and the distribution coefficient of temperature $\beta_2$ for the same aluminum (JIS 5052). In this manner, the distribution coefficient of temperature $\beta_2$ can also be expressed as a function of the rolling conditions. But as can be noted from FIG. 2, since the variation of $\beta_2$ with regard to the variation in the reduction $r$ is small even when we treat $\beta_2$ as a constant, the error caused thereby is small.

Let us consider a simple case wherein an aluminum strip is rolled with a single stand rolling mill. When the strip thickness on the entrance side is denoted by H (mm), the strip thickness on the exit side by $h$ (mm), and the strip thickness when the strain is zero, that is the thickness of the blank by $H_o$ (mm), respective reductions $r$, $\bar{r}_{EN}$ and $\bar{r}_{EX}$ can be expressed as follows:

$$r = l - (h/H) \qquad 10$$
$$\bar{r}_{EN} = l - (H/H_o) \qquad 11$$
$$\bar{r}_{EX} = l - (h/H_o) \qquad 12$$

When the radius of the work rolls is denoted by R (mm) and the peripheral speed thereof by V (m/min), then the strain rate can be expressed by the following equation $$\epsilon = \frac{1000\,V}{60} \sqrt{\frac{r}{R \cdot H}} \cdot \frac{2}{2-r} (\text{sec}^{-1}) \qquad 13$$

The entrance strip temperature $T_{EN}$ can be measured before rolling. Accordingly, unknown data $Km$, $Tm$ and $T_{EX}$ in equations 5, 6, 7 and 8 can be determined by numerical calculations.

Instead of using equation 5, $T_{EX}$ can be expressed as a function of known values as shown by equation 14 and it is possible to predetermine the model of such function.

$$T_{EX} = f_2 (T_{EN} \cdot r_{EN} \cdot \bar{r} \cdot \epsilon) \qquad 14$$

By the process described above, it is possible to correctly determine the mean deformation resistance irrespective of the rolling conditions or the quality of the material being rolled. The rolling load $p$ can be obtained by substituting the value of the mean deformation resistance in equation 1, and the value of $p$ thus determined is substituted in the following equation 15, which is well known in the art as the equation of a gauge meter, to obtain the roll gap $S_o$ at high accuracies.

$$S_o = h - \frac{b \cdot p}{M} \qquad 15$$

wherein
$S_o$ : the set value of the roll gap in mm,
$b$ : the width of the strip in mm and
$M$ : the mill constant in Kg/mm The rolling oil utilized in the cold rolling of aluminum comprises oil that evaporates at low temperature and is used for the purpose of preventing contaminations caused by the oil remaining on the surface of the strip so that such oil has a low flash point thus resulting in a fire hazard. In this manner, the strip temperature comprises one of the factors that determines the rolling schedule. Accordingly, where the exit strip temperature calculated in accordance with equation 4 or 5 is higher than the permissible temperature, it is necessary to correct the rolling speed so as to decrease the exit strip temperature to be less than the permissible temperature. Where the mill stand in question does not correspond to the last mill stand it is possible to correct the stip thickness on the exit side.

Figure 3:
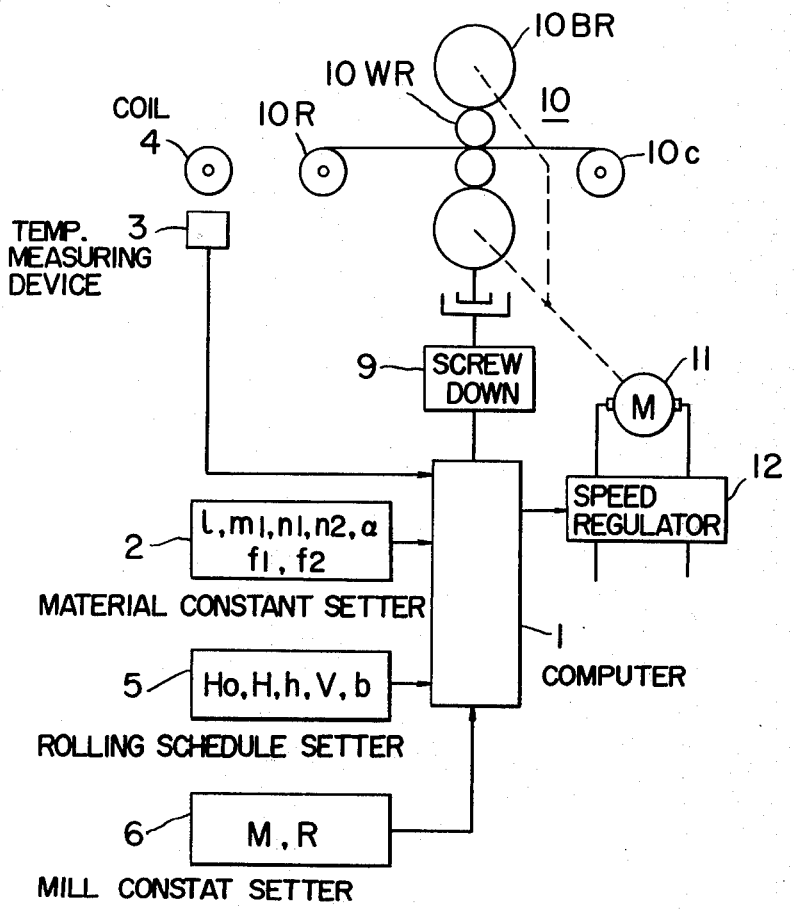
FIG. 3 is a block diagram of the roll gap control apparatus embodying the invention, and FIGS. 4*a*, 4*b* and 4*c*, when combined, show a flow chart explaining the operation of the computer shown in FIG. 3.

FIG. 3 is a block diagram of one example of control apparatus for controlling the roll gap of a cold rolling mill in accordance of the method of this invention. In this figure, an electronic computer 1 designated by a reference numeral 1 has various functions of performing input, output, control, operation and memory and is constructed to perform suitable operation upon inputs, to store the result of the operation, or if necessary to produce an output. Connected with the comptuer 1 are a constant setter 2, a temperature measuring device 3 associated with a coil 4 of the material to be rolled, a rolling schedule setter 5, and a mill constant setter 6. A cold rolling mill 10 comprises a pair of work rolls 10WR, a pair of back-up rolls 10BR, and a screw down adjuster 9. The back-up rolls 10BR are driven by a DC motor 11 and the speed thereof is controlled by a speed regulator 12 which is operated by a command signal from the computer 1. The strip is payed out from a pay out reel 10R and after being rolled by the mill is wound around a take-up reel 10c.

Generally, the calculation of the initial setting of the roll gap is performed during the rolling of a proceding coil. Thus, the temperature of the coil 4 to be rolled next time is measured by a suitable temperature measuring device 3 and the measured value is set in the computer 1. Further, various material constants $l$, $m$, $n_1$, $n_2$ and $\alpha$ which are determined by the quality of the material to be rolled, and functions $f_1$ and $f_2$ in equations 9 and 14 are set in computer 1 by means of setter 2. The rolling schedule including the strip thickness $H_o$ at the time when the strain of the strip is zero, the entrance strip thickness, H, the exit strip thickness to be obtained $h$, the rolling speed V and the width of the strip $b$ are set by the rolling schedule setter 5 and are put into the computer, and the mill constants M and roll radius R are set by the mill constant setter 6 and are put into the computer 1. Then the computer calculates the mean deformation resistance and the exit strip temperature in accordance with equations 4 and 5, and determines the roll gap according to equations 1, 2 and 15. The predetermined roll gap is given to the rolling mill 10 by operating the screw down adjuster 9 in accordance with the calculated value. Where the exit strip temperature is higher than a predetermined permissible exit strip temperature the computer operates to send a correction signal to the speed regulator 12 to correct (decrease) the rolling speed V so as to return the exit strip temperature to a value below the permissible value. At this time, the computer again calculates the mean deformation resistance to give reference values of the roll gap setting and the roll peripheral speed which assure the predetermined exit strip thickness and the predetermined exit strip temperature. In response to this roll gap setting, the screw down adjuster 9 operates to adjust the roll gap to the corrected value.

As has been described hereabove, according to this invention, since readily detectable parameters are used and expressed by simple equations for the purpose of setting the roll gap, not only the control by the computer can be simplified but also the computation thereof can be performed precisely.

Where the calculated strip temperature exceeds the predetermined value, the roll driving speed and the roll gap can be corrected so that the exit strip temperature may not exceed the predetermined value.

Accordingly, if such a speed control is performed, both of the rolling speed and the roll gap are adjusted automatically thus always ensuring products of a definite quality.

While the rolling of an aluminum strip by a single stand mill has been described, the same control can be provided for a tandem mill by forecasting the entrance strip temperature $T_{ENi}$ for the second and following stands according to the following equation 16

$$T_{ENi} = T_c + (T_{EXi-1} - T_c)\, e^{-At} \qquad 16$$

where $$A = 2\delta\rho Shi_{-1} \qquad 17$$

Figure 4A:
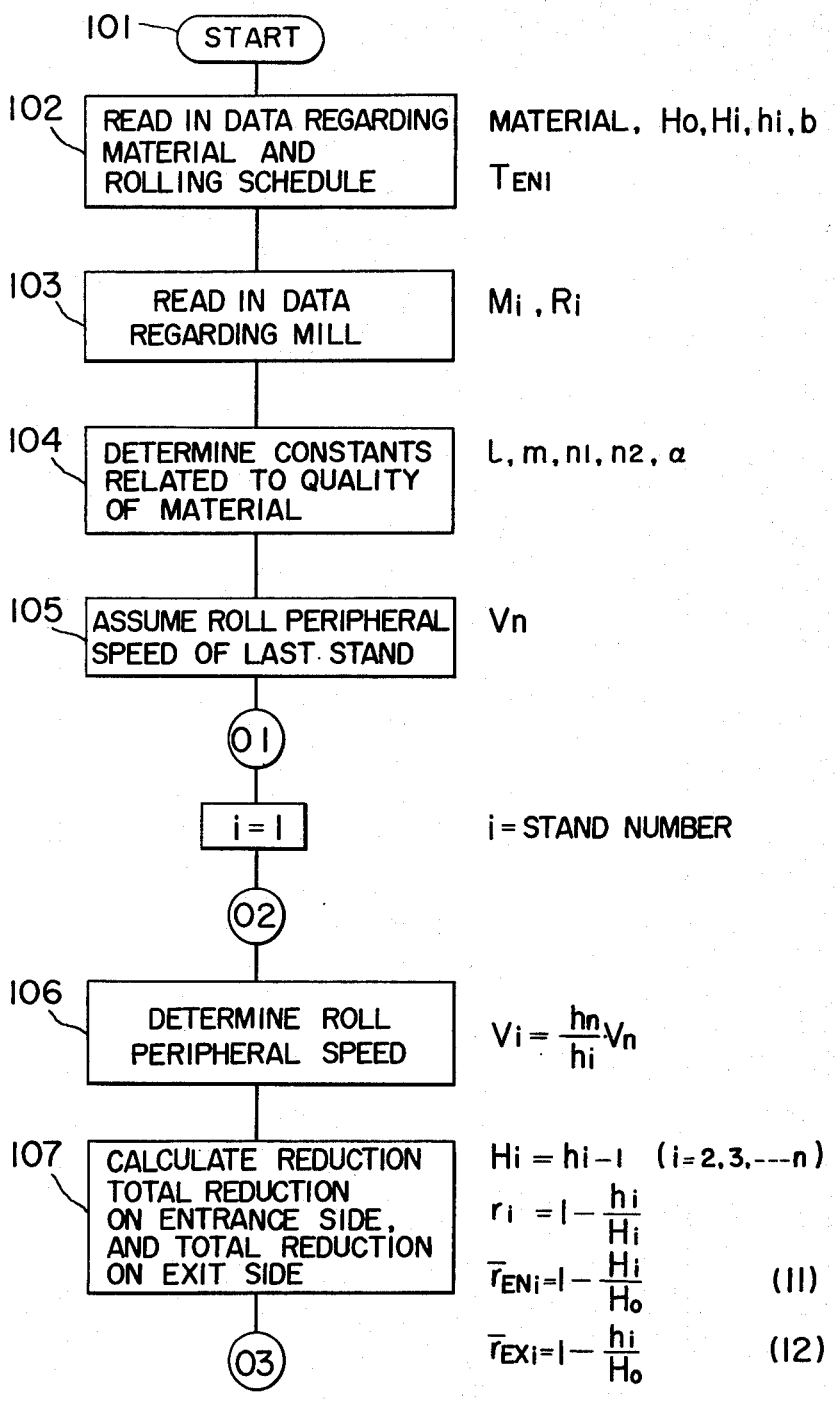
Figure 4B:
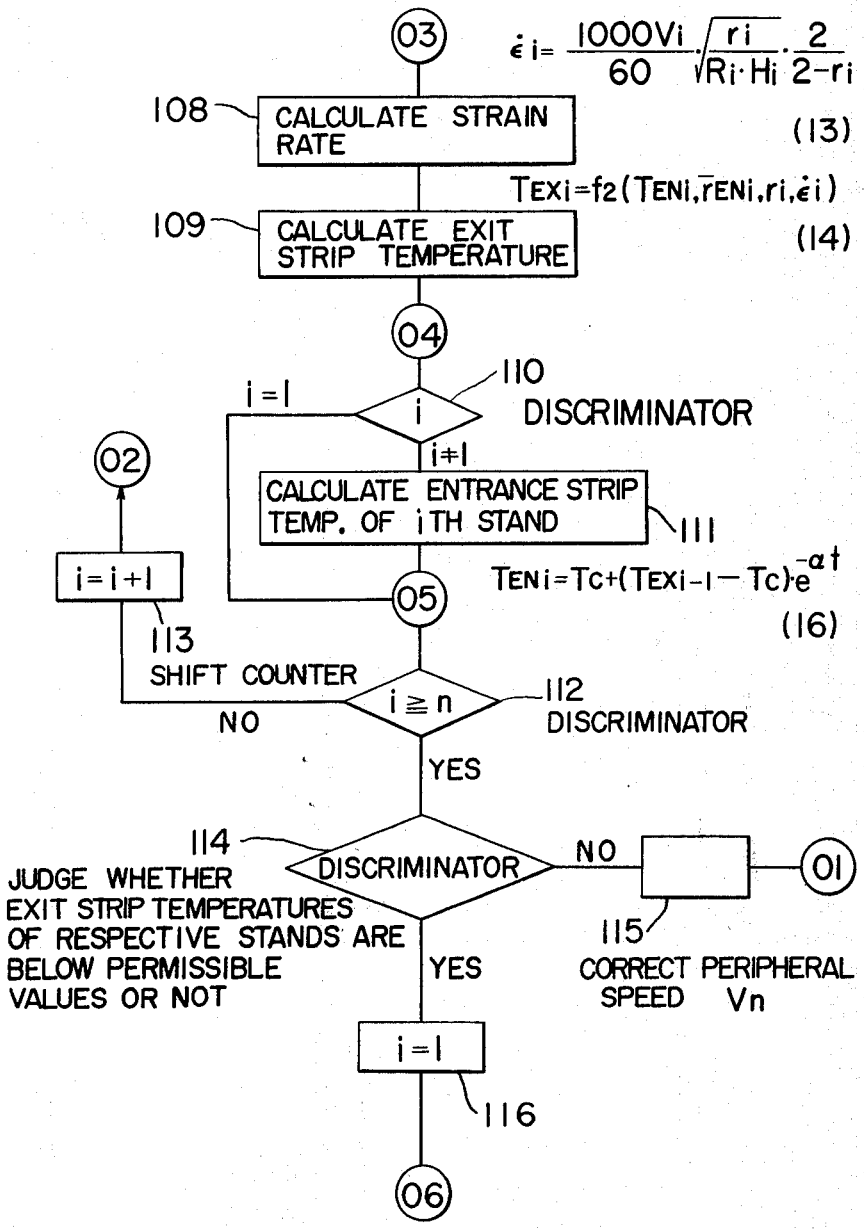
Figure 4C:
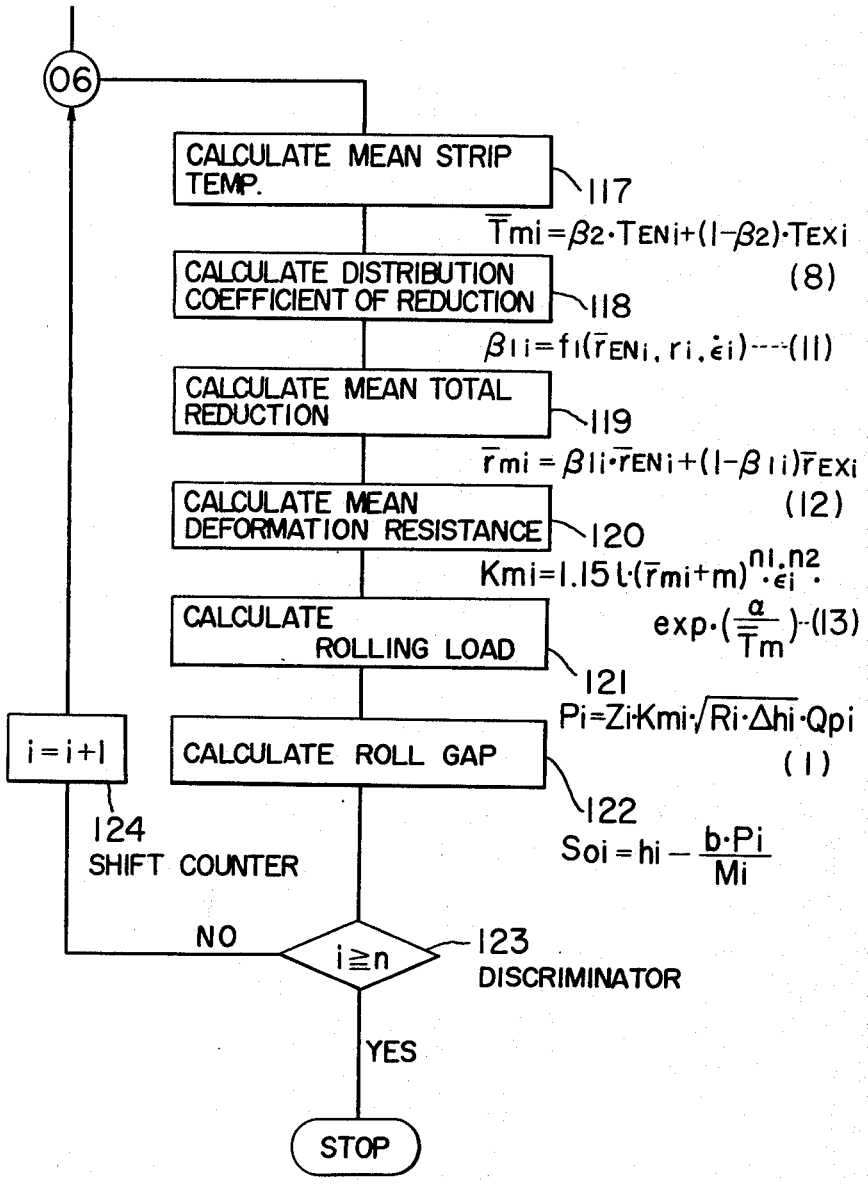

$i$ : any one of the second and following stands $T_c$ : the temperature of the colling medium utilized to cool the strip $\delta$ : the heat transmission coefficient of the cooling medium $t$ : time To have a better understanding of the operation of the computer 1, a flow chart shown in FIGS. 4*a*, 4*b* and 4*c* is used. When connected serially, FIGS. 4*a*, 4*b* and 4*c* complete the flow chart. In this chart, various stages are shown together with equations calculated thereat, and parameters written in the computer. These equations and parameters are smilar to those described above except for suffixes $i$ indicating the stand number is added. Reference points 01 through 06 have no special meaning except those specifically described in the following.

A start signal is first applied at stage 101. In response to this start signal data regarding the material being rolled and the rolling schedule such as $H_o$, $H_1$, $hi$, $b$ and $T_{EN1}$ are read in the computer at stage 102. Then, at stage 103 mechanical data regarding the rolling mill such as $M_i$ and $R_i$ are written into the computer. Then, at stage 104, the constants related to the quality of the material being rolled such as $l$, $m$, $n_1$, $n_2$ and $\alpha$ are determined. It will be seen that the operations performed at stages 102, 103 and 104 correspond to those of the setters 2, 5, 6 and the temperature measuring devices 3 shown in FIG. 3. At stage 105, the peripheral speed V$n$ of the rolls of the last mill stand is assumed. Beginning with the first mill stand, the roll peripheral speed V$i$ at the $i$th stand is determined at stage 106 and the reduction, the total reduction on the entry side and the total reduction on the exit side are calculated at stage 107. Then, the strain rate and the exit strip temperature are calculated at stages 108 and 109 respectively. If the stand number is euqal to 1, the discriminator 110 applies a jumping signal to a second discriminator 112 because at the first stand the temperature of the strip to be rolled is measured by the temperature measuring device 3. If the discriminator 110 judges that the stand is not the first stand, that is $i \neq 1$, then the entrance strip temperature for the $i$th stand is calculated at stage 111. Then, the second discriminator 112 judges whether $i$ is larger than or equal to $n$. When the discriminator 112 judges that $i \neq n$ (or no) then a shift counter 113 supplies an advance signal $i = i + 1$ to a reference point 02 to repeat the operations of stages 106 to 109 until the discriminator 112 judges that $i = n$ (or yes). Then a third discriminator 114 operates to judge whether the exit strip temperatures of respective stands are below respective permissible values or not. In the case of latter (No) stage 115 operates to correct the peripheral speed V$n$ and a signal is sent to reference point 01 to repeat the operations described above until the exit strip temperatures of respective stands are brought to be less than the predetermined values. Then, the discriminator 114 produces a YES signal and when $i = 1$, the signal is sent from stage 116 to a reference point 106. Then, at stages 117 through 122, calculations of the mean strip temperature $Tmi$, the distribution coefficient of the reduction $\beta_{li}$, the mean total reduction $r_{mi}$, the mean deformation resistance $Kmi$, the rolling load $Pi$ and the roll gap $S_{oi}$, respectively, are performed in accordance with equations indicated to the right of respective stages. A signal representing the roll gap calculated at stage 122 is applied to a fourth discriminater 123 which operates to judge whether the calculated roll gap is for the nth stand or not. When the result of judgement is Yes then the computer stops its operation and the screw down adjuster of the $i$th stand will be operated in accordance with the calculated value of the roll gap $S_{oi}$. If the result of judgement is No, then a shift counter 124 applies an advance signal $= i + 1$ to reference point 06 so as to repeat calculations at stages 117 through 122 until the discriminator 123 judges that $= n$.

It should be understood that the invention can also be applied to the cold rolling of other nonferrous metals than alminum and of ferrous metals.

As has been described hereinabove, a roll gap appropriate for different quality of the material being rolled and for different rolling conditions can be automatically set by determining the correct value of the mean deformation resistance of the strip, thus producing strips of the definite gauge.

I claim:

1. A method of controlling the roll gap of a cold rolling mill comprising the steps of measuring the absolute temperature T(°K) of the metal strip being rolled, determining the deformation resistance $K_f$ (kg/mm$^2$) of the metal strip in accordance with an equation $$K_f = l\,(\bar{r} + m)^{n_1} \cdot \epsilon^{n_2} \exp\,(\alpha/T)$$

where $\bar{r}$ represents the total reduction, $\epsilon$ the strain rate (sec$^{-1}$), T the strip temperature (°K), $l$ and $m$ constants, $n_1$ an exponent dependent upon the reduction, $n_2$ an exponent dependent upon the strain rate, and $\alpha$ an exponent dependent upon the temperature (°K); determining the exit strip temperature $T_{EX}$ (°K) in accordance with an equation $$T_{EX} = T_{EN} + \frac{1 - \frac{r}{4}}{1 - \frac{r}{2}} \cdot \frac{Km \cdot \ln\left(\frac{1}{1-r}\right)}{\rho\, S\, J}$$

where $T_{EN}$ represents the entrance strip temperature, $r$ the reduction, $\rho$ the density (Kg/mm$_3$) of the material being rolled, $S$ the specific heat (K cal/Kg °C) of the material, $J$ the work equivalent of heat (Kg.mm/K cal), $Km$ the mean deformation resistance, and $l$ and $m$ constants; determining the mean deformation resistance $K_m$ in accordance with the following equations $$K_m = 1.15\,l\,(\bar{r}_m + m)^{n_1} \cdot \epsilon^{n_2} \exp\,(\alpha/\bar{T}_m)$$

$$\bar{r}_m = \beta_1\, \bar{r}_{EN} + (1 - \beta_1)\, \bar{r}_{EX}$$

$$\bar{T}_m = \beta_2\, T_{EN} + (1 - \beta_2)\, T_{EX}$$

where $L$, $m$, $n_1$, $n_2$, $\epsilon$, $T_{EN}$, $T_{EX}$ and $\alpha$ have the meanings as defined for the equations for $K_f$ and $T_{EX}$, $\beta_1$ represents the distribution coefficient of the reduction, $\beta_2$ the distribution coefficient of the temperature, $\bar{r}_m$ the mean total reduction, $\bar{T}_m$ the mean strip temperature (°K), $\bar{r}_{EN}$ the mean total reduction of the strip on the entrance side and $\bar{r}_{EX}$ the total reduction of strip on the exit side; determining the rolling load $p$ (Kg/mm) by substituting the value of $Km$ in an equation $$p = Z \cdot K_m \sqrt{R' \cdot \Delta h} \cdot QP$$

where $Z$ represents a correction term for tension, $R'$ the roll radius (mm) after the roll has been flattened a little by contact with the strip, $\Delta h$ the amount of reduction and $Qp$ the reduction function regarding the rolling force; determining the roll gap $S_o$ (mm) by substituting the value of $p$ in an equation $$S_o = h - \frac{b \cdot p}{M}$$

where $h$ represents the thickness of the strip on the exit side, $b$ the width of the strip, and $M$ the mill constant (Kg/mm); and adjusting the roll gap in accordance with the value of $S_o$ thus determined.

2. The method according to claim 1 wherein said reduction is determined in accordance with an equation $$r = l - (h/H)$$

the total reduction of the strip on the entrance side $\bar{r}_{EN}$ is determined in accordance with an equation $$\bar{r}_{EN}\; l - (H/H_o)$$

the total reduction of the strip on the exit side $\bar{r}_{EX}$ is determined in accordance with an equation $$\bar{r}_{EX} = l - (h/H_o)$$

and the strain rate $\epsilon$ is determined in accordance with an equation $$\epsilon = \frac{1000\,V}{60} \sqrt{\frac{r}{R \cdot H}} \cdot \frac{2}{2-r}\,(\text{sec}^{-1})$$

wherein $H$ represents the thickness (mm) of the strip on the entrance side, $H_o$ the thickness (mm) of the strip when the strain is zero (or before rolling), $R$ the radius (mm) of the work rolls of the mill and $v$ the peripheral speed (m/min.) of the work rolls.

3. The method according to claim 1 wherein said exit strip temperature $T_{EX}$ is determined in accordance with an equation $$T_{EX} = (T_{EN} \cdot \bar{r}_{EN} \cdot r \cdot 68)$$

where $f_2$ represents a constant, $T_{EN}$ represents the entrance strip temperature, $\bar{r}_{EN}$ represents the mean total reduction of the strip on the entrance side, $r$ represents the reduction, and $\epsilon$ the strain rate (sec $^{-1}$).

4. The method according to claim 1 wherein when the exit strip temperature is different from a predetermined permissible temperature the rolling speed and the amount of reduction are corrected.

5. The method according to claim 1 wherein when said rolling mill comprises a tandem mill, said exit strip temperature is determined in accordance with an equation $$T_{EXi} = T_c + (T_{EXi-1} - T_c)\, e^{-Ai}$$

where $A = 2\,\delta\,\rho Shi_l$, $S$ represents the specific heat (Kg . mm/Kcal), $h$ represents the thickness of the strip on the exit side, suffix $i$ is represents any one of the second and following mill stand, $T_c$ the temperature of the coolant for the strip, and $\delta$ the coefficient of heat transmission of the coolant.

6. A method of controlling the roll gaps of respective mill stands of a tandem cold rolling mill comprising the steps of measuring the temperature of a metal strip being rolled on the entrance side of said mill, forecasting the temperatures of the strip on the exit sides of respective mill stands in accordance with various parameters including the mill constant, the thickness of the strip, and the temperature of the strip; correcting the forecast exit strip temperatures to predetermined permissible values when the forecast exit strip temperatures are different from the predetermined permissible valves; determining the mean deformation resistance in accordance with the reduction, the strain rate, the distribution coefficient of the total reduction of each mill stand and controlling the extent of screw down of each mill stand in accordance with the mean deformation resistance.

7. A method of controlling the roll gap of a cold rolling mill comprising the steps of measuring the temperature of a metal strip being rolled on the entrance side of said mill, determining the deformation resistance of the strip in accordance with a constant determined by the reduction, the strain rate, the measured entrance strip temperature and the quality of the strip, determining the temperature of the strip on the exit side of the mill from the entrance strip temperature by taking into consideration the reduction and the characteristics of the rolling mill, determining the mean deformation resistance of the strip from said deformation resistance and said exit strip temperature, determining the rolling load in accordance with an equation $$p = Z.Km \quad \sqrt{R' . \Delta h} . Qp$$

where $p$ represents the rolling load in Kg/mm per unit width of the strip, $Z$ a correction term for tension, $R'$ the roll radius in mm of the roll after it has been slightly flattened by contact with the strip, $\Delta h$ the amount of reduction in mm, $Qp$ a function regarding the rolling force, and $Km$ the mean deformation resistance determined from said deformation resistance and said exit strip temperature, determining the roll gap in accordance with the following equation of a gauge meter $$So = h - \frac{b \cdot p}{M}$$

where $So$ represents the set value of the roll gap in mm, $b$ the width strip in mm, $h$ the thickness of the strip on the exit side and $M$ the mill constant in Kg/mm, and controlling the roll gap of the mill in accordance with the roll gap determined in accordance with the equation of a gauge meter.

8. Apparatus for controlling the roll gap of a cold rolling mill having a pair of rolls for rolling a metal strip and a screw down device for adjusting the gap between said rolls, said apparatus comprising: a driving motor for driving said rolls; a speed control device for the driving motor; means for measuring the temperature of the strip before it is rolled; a computer including means for setting the measured entrance strip temperature in the computer, means for setting constants and functions related to the quality of the strip in the computer, means for setting a predetermined rolling schedule in the computer, means for setting the mill constant in the computer, means for determining the deformation resistance of the strip in accordance with a constant determined by the reduction, the strain rate, the entrance strip temperature measured by said temperature measuring means, and the quality of the strip, means for determining the temperature of the strip on the exit side of the mill from the entrance strip temperature by taking into consideration the reduction and the characteristics of the rolling mill, means for determining the mean deformation resistance of the strip from said deformation resistance and said exit strip temperature, means for determining the rolling load in accordance with an equation $$p = Z.Km \quad \sqrt{R' . \Delta h} . Qp$$

where $p$ represents the rolling load in Kg/mm per unit width of the strip, $z$ a correction term for tension, $R40$ the roll radius in mm of the roll after it has been slightly flattened by contact with the strip, $\Delta h$ the amount of reduction in mm, $Qp$ a function regarding the rolling force, and $Km$ the mean deformation resistance determined by said mean deformation resistance determining means; means for determining the roll gap in accordance with the following equation of a gauge meter $$So = h - \frac{b \cdot p}{M}$$

where $So$ represents the set value of the roll gap in mm, $h$ the thickness of the strip on the exit side, $b$ the width of the strip in mm and $M$ the mill constant in Kg/mm; means for driving said screw down device in accordance with the roll gap determined by said roll gap determining means; and means for operating said speed control device.

9. Apparatus for controlling the roll gaps of respective mill stands of a tandem cold rolling mill, each mill stand including a pair of rolls for rolling a metal strip, a screw down device for adjusting the gap between said rolls, a driving motor for driving said rolls and a speed control device for the driving motor, said apparatus comprising: means for measuring the temperature of the metal strip before it is rolled; a computer including means for setting the measured entrance strip temperature in the computer, means for setting constants and functions related to the quality of the strip in the computer, means for setting a predetermined rolling schedule in the computer, means for forecasting the temperatures of the strip on the exit sides of respective mill stands in accordance with varioua parameters including the mill constant, the thickness of the strip and the temperature of the strip, means for correcting the forecast exit strip temperatures to predetermined permissible values when the forecast exit temperatures are different from the predetermined permissible values, and means for determining the mean deformation resistance in accordance with the reduction, the strain rate, and the distribution coefficient of the total reduction of each mill stand; means responsive to the determined mean deformation resistance for driving the scew down devices of respective mill stands; and means for operating said speed control device.

10. The apparatus according to claim 9 wherein said means for forecasting the exit strip temperatures comprises means for determining said exit strip temperatures in accordance with an equation $$T_{KNI} = Tc + (T_{KXI-1} - {}^{tc}) \; e \; At$$

where $A = 2 \; \delta\rho \; Shi_1$, $S$ the specific heat (K cal/Kg°C) of the strip material, $h$ the thickness of the strip on the exit side, suffix $i$ represents any one of the second and following mill stands, $Tc$ the temperature of the collant for the strip, and $\delta$ the coefficient of heat transmission of the coolant.

* * * * *